United States Patent [19]

Buckshaw et al.

[11] Patent Number: 5,065,972

[45] Date of Patent: Nov. 19, 1991

[54] CORNER BUMPER

[76] Inventors: Dennis J. Buckshaw, 42240 Crestview Cir., Northville, Mich. 48167; James A. Clark, 7309 Manor Cir. #202, Westland, Mich. 48185

[21] Appl. No.: 592,779

[22] Filed: Oct. 4, 1990

[51] Int. Cl.[5] ..... A47B 95/00

[52] U.S. Cl. ..... 248/345.1; 206/586

[58] Field of Search ..... 248/345.1, 205.3, 300, 248/174; 229/198.1, DIG. 1; 206/506; 220/85 K

[56] References Cited

U.S. PATENT DOCUMENTS

| | | | |
|---|---|---|---|
| 459,251 | 9/1891 | Hall | 248/345.1 |
| 3,031,162 | 4/1962 | Whorton | 248/300 |
| 3,762,626 | 10/1973 | Dorsey | 248/345.1 X |
| 3,900,156 | 8/1975 | Clark, Jr. | 248/345.1 X |
| 4,063,702 | 12/1977 | Wilde et al. | 248/345.1 |
| 4,817,902 | 4/1989 | Mason | 248/345.1 |
| 4,840,342 | 6/1989 | Sweeny et al. | 240/345.1 X |
| 4,852,744 | 8/1989 | Van Breemen | 248/345.1 X |
| 4,877,673 | 10/1989 | Eckel et al. | 248/345.1 X |
| 4,883,281 | 11/1989 | Waterman | 248/345.1 X |
| 4,972,954 | 11/1990 | Dickie | 248/345.1 X |

*Primary Examiner*—Carl D. Friedman
*Assistant Examiner*—Korie H. Chan
*Attorney, Agent, or Firm*—Krass & Young

[57] ABSTRACT

A protective bumper which can be removably mounted on the corners and edges of furniture and the like. The bumper comprises a resilient bumper portion having an interior surface which is configured to provide an air space between the bumper and the corner which it protects to act as a shock absorber, reducing the risk of injury to a person colliding therewith and damage to the table if you hit it with, for example, the vacuum cleaner. The bumper portion is provided with first, second and third mounting flaps which mold and adhere to the surface of a table. Two end flaps formed on the third mounting flap fold to adhere to the first and second mounting flaps, thereby reinforcing their attachment to the furniture surface.

9 Claims, 1 Drawing Sheet

22
16b
20
16c
18
16
18c
12
19
20
26
22
16a
17b
10
24
17c
17a
17

30
32
19
26
12
10
22
17
14
24
30

CORNER BUMPER

TECHNICAL FIELD OF THE INVENTION

This invention relates to removable protective bumpers for the corners and edges of furniture and the like.

BACKGROUND OF THE INVENTION

The sharp corners and edges of furniture, appliances, and similar items pose the hazard of bodily harm to persons accidentally colliding therewith, particularly small children. It is well-known to provide such corners and edges with cushions or bumpers to reduce the risk of injury to a person colliding therewith. Some disadvantages and drawbacks of the prior art include insufficient shock-absorbing capability, difficulty in conforming to the surfaces of furniture and the resulting tendency to fall off or come undone, and susceptibility to removal by small children.

U.S. Pat. No. 3,150,854 to Jamieson discloses a pre-formed corner protector integrally molded from soft rubber or plastic for mounting on the edges and corners of furniture. Two vertical sidewalls are interconnected at their junction by a hollow, bulbous portion and at their top edges by a horizontal top wall. As stated above, the Jamieson device is pre-formed; i.e., it is molded in its final, three-dimensional shape for a furniture corner of particular configuration. Because the Jamieson device is molded in its final configuration, it does not adapt itself well to corners and edges of furniture which vary even slightly from the configuration for which it was molded; e.g., for a corner or edge formed by surfaces intersecting at an angle even slightly different from that for which a particular device was molded, a different device made from a separate mold would be required.

Futhermore, it is well-known that molds for forming relatively deep, three-dimensional objects are more expensive to manufacture and less efficient to use than molds for forming articles which are essentially flat. Also, stacking, storing and shipping of pre-formed, three-dimensional devices such as Jamieson's is less efficient because the device requires more space than an essentially flat article and is more likely to be deformed or damaged in storage or transit.

A problem encountered in forming a resilient rubber or plastic device as an essentially flat blank for folding and mounting on a nonflat surface is that the "memory" of the resilient material tends to cause the device to return to its flat or unfolded state.

SUMMARY OF THE INVENTION

The present invention is a protective bumper for mounting on corners and edges of furniture, which bumper can be molded as an essentially flat blank from resilient rubber or plastic and which can be folded and attached to a corner or edge in a secure manner without the memory of the material weakening its attachment thereto. The bumper comprises a substantially cylindrical bumper having two planar mounting flaps running axially along the length of the bumper portion on essentially opposite sides thereof. The mounting flaps are foldable relative to the bumper portion.

A third mounting flap is attached to an end face of the bumper portion essentially coplanar with the first two mounting flaps and foldable to a furniture-engaging position essentially perpendicular to the first two mounting flaps. The third mounting flap has two opposite end portions biased to fold at a predetermined angle relative thereto.

The resilient bumper portion is configured such that an air space exists between the bumper portion and the corner or edge to which it is mounted. The air space allows the bumper portion to function as an air shock-absorber.

To mount the protective bumper on a hazadous corner or edge, the resilient bumper portion is aligned with the corner or edge and the first and second mounting flaps are folded to engage the two surfaces which intersect to form the edge. Preferably, the inside surfaces of the mounting flaps are provided with a suitable adhesive to secure the flaps to the article of furniture. In the same manner, the third mounting flap adheres to the top (or bottom) surface of the article of furniture, such as a table top, and its end portions fold down and adhere to the outer surfaces of the first and second mounting flaps to reinforce the attachment of the flaps to the table.

The resilient bumper portion of the protective bumper provides a dual layer of protection to prevent injury to someone colliding with the edge of corner: the resilient bumper acts first as a cushion preventing direct contact with the corner of edge, and second as an air shock-absorber to dissipating the energy of the impact.

The first and second mounting flaps are slotted or otherwise biased at their junction with the resilient bumper portion to reduce the memory of the plastic. This provides for easier folding and molding of the flaps to furniture surfaces and reduces the tendency of the flaps to spring back once fastened to a surface.

The mounting flaps are preferably formed of very thin plastic, the edges of which are beveled or rounded to make it difficult for the flaps to be pried or picked off by small children once fastened to a surface.

DETAILED DESCRIPTION OF THE DRAWINGS

Figure 1:
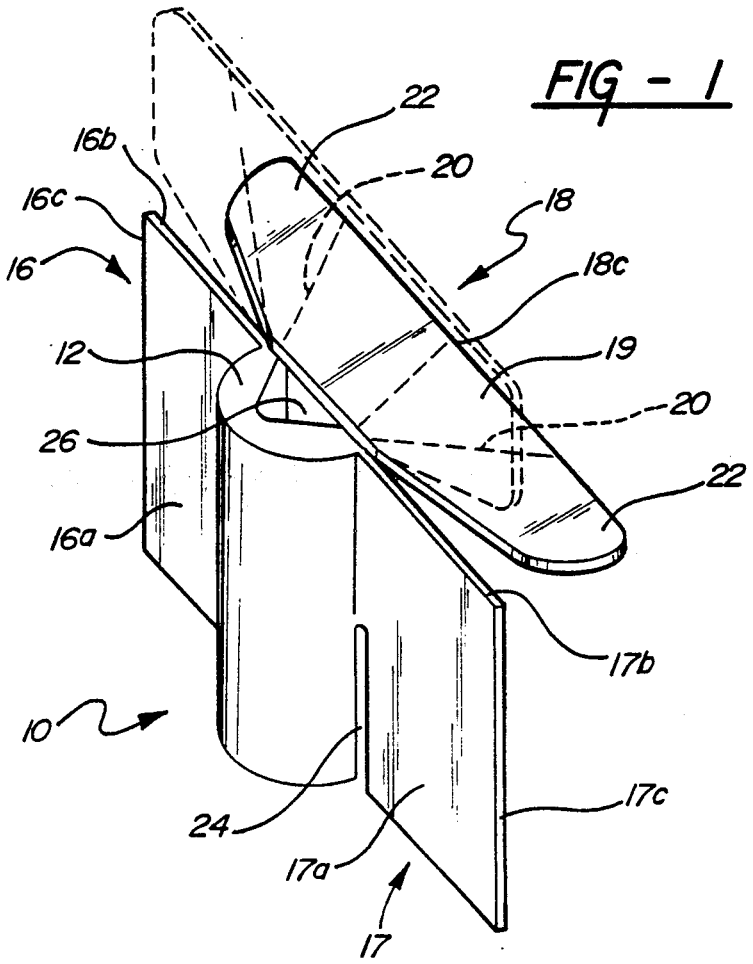
FIG. 1 is a perspective view of the protective bumper of the present invention.

Referring to FIG. 1, the protective bumper of the present invention comprises a substantially cylindrical resilient bumper portion 10 having end surfaces 12 and rounded front face 14. Bumper portion 10 is preferably made of resilient plastic, such as polyvinylchloride for example, but other suitable material such as rubber or foam could also be used. Rectangular mounting flaps 16 and 17 are formed on opposite sides of bumper portion 10 and, with end faces 12, essentially define the boundary of front face 14.

In this illustrated embodiment, bumper portion 10 and mounting flaps 16 and 17 are integrally molded from the same resilient material, so that front face 14 and front faces **16*a* and 17*a* bumper portion 10 and flaps 16 and 17 are essentially continuous. It can also be seen that top edges 16*b* and 17*b* of flaps 16 and 17 are co-planar with upper end face 12. Due to the resiliency of the bumper material, flaps 16 and 17 can be folded or hinged about an axis essentially corresponding to their connection with resilient bumper portion 10**.

A third mounting flap 18 is connected to bumper portion 10 at the junction of end face 12 and top edges 16*b* and 17*b*. Flap 18 is essentially co-planar with flaps 16 and 17 in an unfolded condition shown in phantom and can be folded essentially perpendicular to flaps 16 and 17 as shown by solid lines. When folded, the bottom surface (not shown) of flap 18 is essentially level with or slightly above top edges 16*b* and 17*b*, allowing flaps 16 and 17 to be folded rearwardly of bumper portion 10 without interference from flap 18.

Flap 18 is provided with fold lines 20 which define end portions 22. Fold lines 20 in this illustrated embodiment are formed as grooves or regions of reduced thickness which permit end portions 22 to be easily folded downward about the fold line relative to flap 18 and which reduce the memory or tendency of end portions 22 to spring back to their unfolded position.

Mounting flaps 16 and 17 are further provided with longitudinal slots 24 at their junction with resilient bumper portion 10. These slots reduce the area at which flaps 16 and 17 are connected to resilient bumper portion 10, effectively reducing the memory of the flaps; i.e., the tendency of flaps 16 to return or spring back to the unfolded position shown in FIG. 1 after being folded. While slots 24 are shown as extending all the way through flaps 16 and 17, they may take almost any suitable form, such as the grooves of fold lines 20, which reduces the folding memory of the flaps.

Resilient bumper portion 10 has an inner geometry as shown at 26, which ensures that an air space is maintained between bumper portion 10 and an edge or corner upon which it is mounted. In the wedge-shaped configuration of the illustrated embodiment, the included angle of inner walls 26 is less than the angle of the surfaces which intersect to form the corner or edge upon which bumper portion 10 is mounted, thereby preventing the interior surface of bumper portion 10 from conforming exactly to the corner or edge. Also, with such a configuration the resilient nature of bumper portion 10 will tend to clamp the base portions of inner walls 26 against the surfaces forming the edge or corner. The air between resilient bumper portion 10 and the corner or edge (see FIG. 2) acts to absorb shock, dissipating the energy of impact as the air is compressed and forced out from between the bumper portion and the corner or edge.

Figure 2:
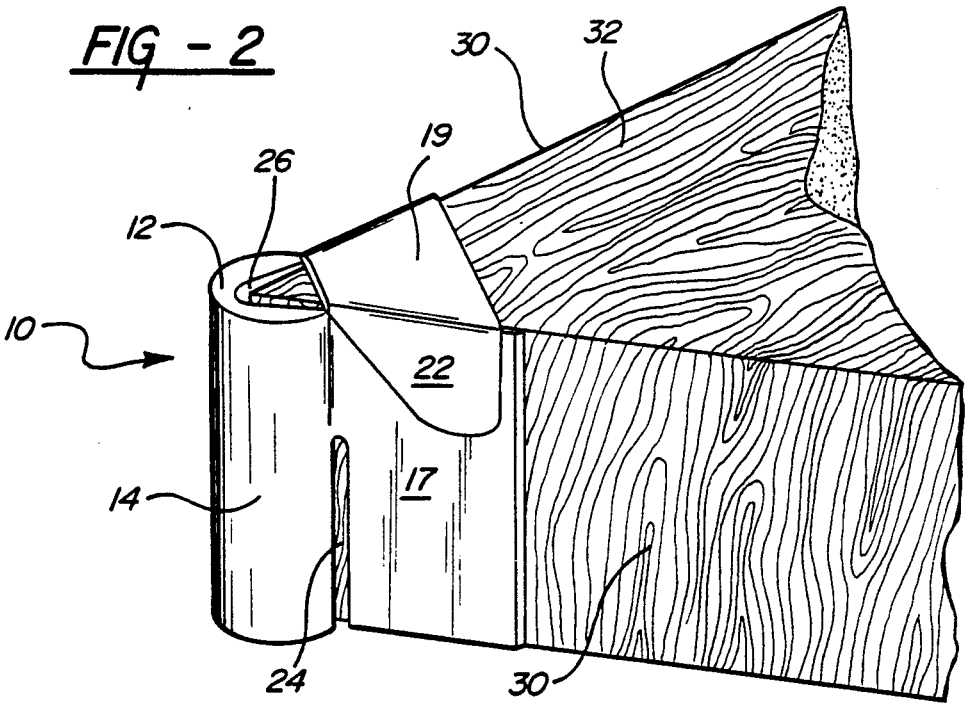
FIG. 2 is a perspective view of the protective bumper of the present invention mounted on the corner of a table.

Referring now to FIG. 2, the protective bumper of the illustrated embodiment in FIG. 1 is shown mounted on the corner of a table 28 having edges 30 and top surface 32. Resilient bumper portion 10 is aligned over the corner edge of the table and flaps 16 and 17 are folded into engagement with edges 30. In this preferred embodiment, flaps 16 and 17 are provided with a reusable adhesive coating on their table-engaging surfaces, protected between uses by removable paper backing or the like. The combination of the adhesive and the memory-reducing slots 24 ensures that flaps 16 and 17 do not inadvertently spring back into their unfolded position once applied to the table edge.

Central portion 19 of top mounting flap 18 engages the top surface 32 of the table in the same manner as flaps 16 and 17; i.e., the inner surface of central portion 19 is provided with a reusable adhesive coating to adhesively engage the table surface.

End portions 22 are next folded downwardly about fold lines 20 to engage mounting flaps 16 and 17. End portions 22 are also coated with a reusable adhesive on their inner faces such that they securely adhere to flaps 16 and 17. End portions 22 in this position serve to reinforce the engagement of flaps 16 and 17 with the table edges 30 by maintaining flaps 16 and 17 in their folded position.

It should be noted that the angle at which fold lines 20 are formed in mounting flap 18 essentially conforms to the angle at which table edges 30 intersect, such that fold lines 20 are essentially aligned with edges 30. This arrangement ensures that edges 30 and flaps 16 mounted thereon do not interfere with the downward folding of end portions 22. This arrangement also ensures that end portions 22 fold down neatly and securely onto flaps 16 and 17 without any bunching up of extra material or undue stretching or strain.

The foldable nature of mounting flaps 16, 17, and 18 and memory-reducing slots 24 allow a single protective bumper to mold neatly and securely to corner and edge surfaces of varying sizes and intersecting angles. The only feature of the protective bumper which need be altered to adapt the bumper to different corners and edges formed by surfaces intersecting at different angles are fold lines 20. Specifically, the angle at which fold lines 20 intersect the junction of flaps 16 and 17 and bumper portion 10 can be varied. For example, for a table corner formed by edges intersecting at an acute angle, a first bumper could have fold lines intersecting bumper portion 10 at a corresponding acute angle. For edges intersecting at right angles to one another, or at an obtuse angle, second and third protective bumpers could have fold lines intersecting at corresponding normal and obtuse angles, respectively. Alternately, a single protective bumper could have two or more sets of fold lines formed in mounting flap 18 at varying angles (acute, normal, etc.) to correspond and be adaptable to a variety of corners and edges.

Once mounted, the protective bumper provides protection from injury resulting from collision with the corner of the table. The solid portion of resilient bumper 10 first acts as a resilient cushion, preventing contact with the sharp corner or edge of the table, and the air between the inner walls of resilient bumper portion 10 and the corner or edge acts as an air shock-absorber to dampen or dissipate the force of impact. This two-fold action greatly reduces the potential for injury to a person accidentally colliding with the bumper.

To prevent the protective bumper from being inadvertently scraped off its mounted position on the table, or from being easily peeled off by small children, the exposed edges of mounting flaps 16, 17, and 18 are very thin are beveled or rounded to make it difficult to pick or pull the flaps off once fastened to another surface or to each other.

It is clear from the foregoing description that the protective bumper of the illustrated embodiment can be simply and efficiently manufactured and quickly, easily, and securely mounted on the corner or edge of an article of furniture or the like to reduce the risk of serious injury to a person colliding therewith. It is also clear that the protective bumper of the illustrated embodiment is easily adapted to edges and corners formed by surfaces intersecting at varying angles and, once mounted, is not likely to inadvertently become detached or dismounted or to be removed by small children.

The foregoing illustrated embodiment is described and set forth to meet the requirements of 35 USC 112, and is not intended to be limiting, as many modifications and embodiments may lie within the scope of the appended claims. For example, the protective bumper may be formed to conform to almost any type of corner or edge, the shape of resilient bumper portion 10 and/or the configuration of its inner wall or walls may vary, the various flaps may be attached by means other than adhesive, etc.

I claim:

1. A protective bumper for mounting on the corners and edges of furniture and the like, comprising:

a substantially cylindrical, resilient bumper portion, having two side edges, two end edges, a rounded front face, and an interior surface opposite said front face, said interior surface configured such that it conforms only partially to said corner or edge upon which said resilient bumper portion is mounted;

first and second planar mounting flaps having front and rear planar faces, each of said flaps having one generally linear edge integral with a respective side edge of said resilient bumper portion and extending radially outwardly from the respective side edge, each of said flaps being otherwise free and unattached to any other portion of said bumper so that it may fold freely about its integral linear edge;

a third mounting flap connected only to one of said end edges of said resilient bumper portion, extending therefrom substantially coplanar with said first and second mounting flaps in an unfolded condition, and having end portions which are biased to fold at least one predetermined angle relative to said third flap; wherein, said resilient bumper portion is positioned over a corner or edge of an article formed by at least two intersecting surfaces, with said rounded front face opposite said corner or edge, and said first, second and third mount flaps are folded to engage said article and each of said end portions is folded to engage one of said first and second mounting flaps.

2. Apparatus as defined in claim 1, wherein the portions of said first and second planar mounting flaps engaging said article of furniture are coated with adhesive.

3. Apparatus as defined in claim 1, wherein at least one memory reducing slot is formed in each of said first and second mounting flaps, along its integral edge with said bumper portion.

4. Apparatus as defined in claim 1, wherein said first and second planar mounting flaps are very thin relative to said resilient bumper portion.

5. Apparatus as defined in claim 4, wherein the portion of said edge of said mounting flaps not connected to said resilient bumper portion is beveled.

6. Apparatus as defined in claim 1, wherein said protective bumper comprises an integral piece of resilient plastic.

7. Apparatus as defined in claim 1, wherein said end portions of said third mounting flap are biased to be selectively folded at a plurality of predetermined angles relative to said third mounting flap.

8. A protector for protecting a corner defined by intersecting side surfaces and a top surface of the article defining the corner, said protector formed from a generally planar blank of unitary plastic material and including:

a central elongated bumper portion having side edges and a top end edge and having a convex, rounded front surface and a concave wedge-shaped configuration along its rear surface sized to receive the edge formed by the intersection of said side surfaces;

first and second side mounting flaps each secured integrally along one edge thereof to a respective side edge of said bumper portion but being otherwise unattached to any other portion of said protector so as to fold freely along said integral edge thereof into seating engagement against a respective of said side surface defining the corner; and a top mounting flap secured integrally along one edge thereof to the top end edge of said bumper portion but being otherwise unattached to any other portion of said protector so as to fold freely along said integral edge thereof into seating engagement against said top surface.

9. A protector according to claim 8 wherein said top flap includes score lines which allow end portions of the flap to be folded down over said side flaps after said side flaps have been folded against said side surfaces.

* * * * *